US006684953B2

(12) United States Patent
Sonnier

(10) Patent No.: US 6,684,953 B2
(45) Date of Patent: Feb. 3, 2004

(54) WIRELESS PACKER/ANCHOR SETTING OR ACTIVATION

(75) Inventor: James A. Sonnier, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 37 days.

(21) Appl. No.: 09/767,184

(22) Filed: Jan. 22, 2001

(65) Prior Publication Data

US 2002/0096325 A1 Jul. 25, 2002

(51) Int. Cl.[7] ..... E21B 43/00; E21B 7/06; E21B 23/03

(52) U.S. Cl. ..... 166/255.3; 166/66; 166/117.6

(58) Field of Search ..... 166/50, 65.1, 66, 166/117.6, 255.3; 175/61, 80, 81, 82

(56) References Cited

U.S. PATENT DOCUMENTS

| | | | | |
|---|---|---|---|---|
| 4,184,545 A | | 1/1980 | Claycomb | 166/133 |
| 4,896,722 A | | 1/1990 | Upchurch | 166/250 |
| 5,034,929 A | | 7/1991 | Cobern et al. | 367/83 |
| 5,050,675 A | | 9/1991 | Upchurch | 166/250 |
| 5,109,924 A | | 5/1992 | Jurgens et al. | 166/117.5 |
| 5,199,513 A | | 4/1993 | Stewart et al. | 175/73 |
| 5,443,129 A | * | 8/1995 | Bailey et al. | 166/117.6 |
| 5,676,206 A | | 10/1997 | Rehbock et al. | 166/117.5 |
| 5,678,634 A | | 10/1997 | Rehbock et al. | 166/377 |
| 5,732,776 A | | 3/1998 | Tubel et al. | 166/250.15 |
| 5,881,808 A | | 3/1999 | Rehbock et al. | 166/117.5 |
| 5,893,413 A | | 4/1999 | Lembcke et al. | 166/66.6 |
| 5,941,307 A | * | 8/1999 | Tubel | 166/313 |
| 5,947,201 A | | 9/1999 | Ross et al. | 166/298 |
| 6,105,690 A | | 8/2000 | Biglin, Jr. et al. | 175/48 |
| 6,138,756 A | * | 10/2000 | Dale | 166/117.5 |

FOREIGN PATENT DOCUMENTS

| | | | |
|---|---|---|---|
| EP | 0584997 A2 | 2/1994 | E21B/41/00 |
| EP | 0551136 A1 | 7/2003 | G02F/1/17 |
| WO | WO 99/31351 | 6/1999 | E21B/34/14 |

OTHER PUBLICATIONS

Copy of Search Report Under Section 17 for GB 0201329.0.

* cited by examiner

*Primary Examiner*—David Bagnell
*Assistant Examiner*—Brian Halford
(74) *Attorney, Agent, or Firm*—Madan, Mossman & Sriram, P.C.

(57) ABSTRACT

The present invention discloses the concept of using, for the purpose of operating a well control tool such as setting a packer, slip or whipstock, wireless data signal emissions from a downhole telemetry instrument such as an MWD or LWD unit that is energized by pumped fluid flow along a surface connected tubing string. The well control tool may be one that derives operating energy in situ such as from well bore fluid pressure or batteries. Operation of the well control tool is triggered by a battery powered microprocessor that is programmed to respond to a predetermined sequence of wireless data signal emissions from the telemetry instrument. Control over the wireless data signal sequence is exercised by control over the pumped flow stream such as by starting and stopping the pump or diverting the downhole flow stream.

12 Claims, 3 Drawing Sheets

WIRELESS PACKER/ANCHOR SETTING OR ACTIVATION

BACKGROUND OF THE INVENTION

1. Field of the Invention

The present invention relates to the art of earthboring. More particularly, the invention relates to methods and apparatus for setting well annulus packers and tool slips, generally, but also specifically when the packer is run in combination with a whipstock.

2. Description of Related Art

The traditional method of directional drilling includes a tapered steel guide for the drill string characterized as a "whipstock". The whipstock function is to deflect the milling/boring direction of the drill string cutting mill/bit from a previously drilled borehole toward a different, selected direction. Over a length of about 10 to 25 feet, the guide taper of the whipstock deflection surface turns the borehole axis from coincidence with the existing borehole to a deflected line of about 1° to about 10°.

Procedurally, the whipstock is usually secured within an existing borehole casing by a packer/slip tool located along the whipstock length below the bottom end of the deflection surface. The packer is required to seal the existing borehole below the whipstock from fluid communication with the deflected borehole. The slips are required to oppose the considerable thrust force upon the whipstock along the existing borehole axis and the torque force imposed by the deflected drill string rotation.

Although the whipstock deflects the bit cutting direction within the casing, that deflection simply turns the drill bit into the casing wall. Consequently, after the whipstock is set, it is then necessary to cut a window into the casing wall to facilitate advancement of the drill bit into the earth along the deflected direction. The window is cut by a steel milling tool at the end of the drill string. Following the milling tool can be one or more hole reaming tools to enlarge the casing window.

To avoid multiple "trips" in and out of the borehole to perform the multiple operations required, the whipstock and packer/slip tools are combined with a casing mill and one or more reamers. The integrated combination is secured to the end of a drill string. The prior art provides a fluid conduit along the whipstock length to connect the drilling string pipe bore to the packer/slips. When the face of the whipstock deflection surface is directionally oriented, the packer and slips are engaged by fluid pressure supplied and controlled by surface pumps or, alternatively, by using the in situ hydrostatic pressure in the well bore applied against an atmospheric pressure chamber. The casing mill is disconnected from the upper end of the whipstock and lowered against the whipstock deflection surface while rotating to cut the casing window.

For directional orientation, the present state of the art relies upon telemetering technology characterized as "measuring while drilling" (MWD) or "logging while drilling" (LWD). Among other features and capacities, an MWD unit reports downhole characteristics of the drilling operation to a surface receiving unit. These downhole characteristics are reported as wireless (e.g. sonic) signal propagations transmitted, for example, along the column of drilling fluid within the associated drill pipe as the signal carrier medium. Circulating drilling fluid (i.e., mud) that is pumped downhole along the drill string tube bore drives a turbogenerator for signal generation energy. One of the characteristics reported by an MWD unit is the azimuth direction of the vertical plane that passes through the "high side" of the bore hole. Also reported is the borehole angle of departure from vertical. Knowing this geometry, the whipstock deflection surface may be accurately set in the desired direction relative to the "high side" plane direction.

One of the difficulties attendant to the prior art equipment and procedure as described above is the need for hydraulic connections between the drill string tubing bore and the whipstock packer/slip unit. As presently practiced, that connection comprises a boring along the length of the whipstock joint: an extremely difficult and expensive machining operation. At the upper end of the boring, the whipstock conduit is connected to the drill string with preformed or flexible tubing via a pressure set hydraulic valve. Both the tubing and the valve are vulnerable to malfunction and in-running damage.

It is, therefore, an objective of the present invention to provide a one-trip whipstock setting procedure that requires no hydraulic connection between the packer/slip unit and the drill string.

Another object of the present invention is a packer or slip setting procedure that is actuated by wireless MWD or LWD signals.

Also an object of the invention is a whipstock setting procedure that is faster and more reliable than prior art equipment and procedures.

A further object of the present invention is to use commonly used, state of the art equipment that is needed downhole to ascertain azimuth orientation of the drill string and whipstock deflection face to also activate the whipstock packer and/or anchor.

SUMMARY OF THE INVENTION

These and other objects of the invention are accomplished by a whipstock joint having a packer/slip unit disposed below the whipstock. The packer/slip unit may be actuated by in situ energy such as hydrostatic well pressure. The hydrostatic actuator for the packer/slip unit comprises a motor chamber for driving the packer and slip actuating pistons. Wellbore fluid flow through an internal conduit connected with the motor chamber is sealed by a solenoid valve. The solenoid valve is opened by a battery powered operating signal from a microprocessor. Opening of the solenoid valve admits in situ well bore pressure into the actuator motor chamber. The microprocessor is responsive to MWD or LWD transmitter signals but only in a preprogrammed sequence that may be controlled by selective operation of the tubing string mud flow.

As the one-trip whipstock equipment combination is run into the wellbore, drilling fluid (mud) is circulated down the drill pipe or coiled tubing bore to operate the MWD or LWD turbogenerator. When the desired whipstock deflection depth is found, the deflection surface is oriented by rotation of the drill string relative to the borehole highside azimuth as is reported by the MWD unit.

At this point, the drilling fluid pump or circulation control is operated in a predetermined manner to emit a distinctive signal pattern by the MWD transmitter. For example, the distinctive signal may be the absence of a signal transmission as the result of terminating the drilling fluid flow. Such distinctive signal pattern may be characterized as a reference or alert signal. Following the alert signal, the drilling fluid pump or flow control is operated in a further distinctive manner such as a programmed sequence of timed interval starts followed by timed interval stops, for example. The microprocessor that controls the packer/slip actuator is programmed to respond to the distinctive MWD signal transmission by emitting an operating power signal to the packer/slip solenoid valve. When the solenoid valve receives its power signal from the microprocessor, the valve opens to admit wellbore pressure into the packer/slip motor chamber. Resulting wellbore pressure entering the packer/slip motor chamber sets the whipstock packer and anchor slips. In a shallow well application, where the in situ pressure may be insufficient for packer or anchor setting, additional wellbore pressure may be applied externally to complete the setting procedure. From that point, the whipstock procedure continues in the manner known to the art.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which.

DESCRIPTION OF THE PREFERRED EMBODIMENTS

Figure 1:
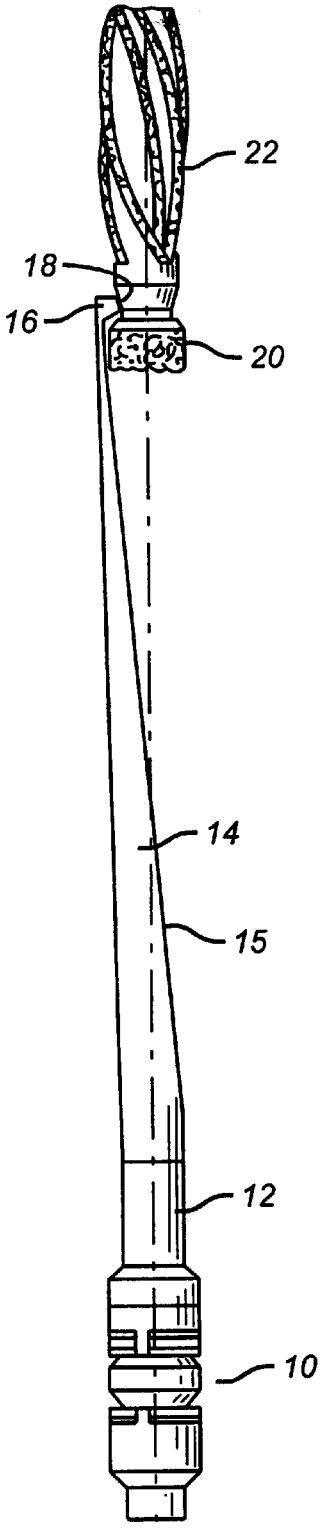
FIG. 1 is an elevation view of the invention lower tool combination.
Figure 2:
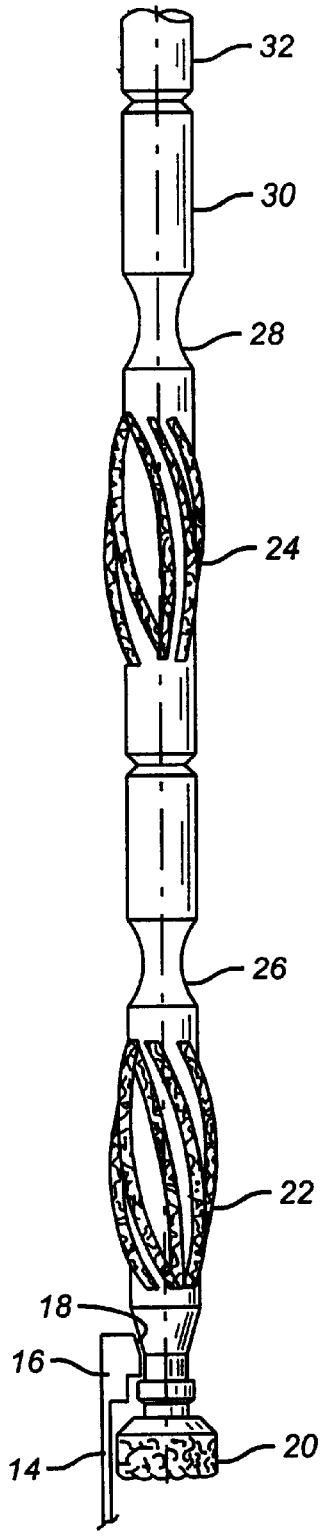
FIG. 2 is an elevation view of the invention upper combination

With respect to the invention embodiment illustrated by FIGS. 1 and 2, a serial assembly of downhole tools is shown to extend from the end of a downhole tubing string 32, for example. The term "tubing string" is used to include either drill pipe or coiled tubing having a fluid channeling conduit along a continuous central bore. The tubing string extends from the surface as structural support for and control of the bottom hole tool assembly. The bottom hole tool assembly for the present invention includes but is not limited to, a unitized packer/slip unit 10. Adjacent to the packer/slip unit is a packer/slip actuator 12. The actuator 12 is described with greater particularity in reference to FIG. 3. Above the actuator is a downhole well control tool such as a whipstock 14 having a deflection surface 15. The whipstock 14 is nominally secured to the casing mill 20 by means of an anchor shoe 16 and a shear fastener 18. The conduit continuity of the tubing string 32 usually, but not always, extends only to the casing mill 20. Fluid carried within the tubing string conduit may be drilling fluid (mud), water or hydraulic oil, as examples. Hereafter, the terms "mud" or "drilling fluid" are intended to encompass any fluid that transferred or circulated from the surface down the tubing conduit by a pump.

Following the casing mill 20 in the bottom to top assembly sequence is a first reaming tool 22 for casing window enlargement. A second reaming tool 24 may be connected to the first tool 22 by a flexible joint 26. A second flex joint 28 may or may not be assembled between the second reaming tool 24 and a telemetry instrument 30.

Between the tubing string 32 and the upper milling assembly, for example, is a downhole telemetry instrument 30 such as a Measuring While Drilling (MWD) or a Logging While Drilling (LWD) unit as described by U.S. patent application Ser. No. 09/204,908, now U.S. Pat. No. 6,347,282, for example. Characteristically, the telemetry instrument 30 transmits measured downhole data on a wireless signal emission. For example, sonic signal emissions are carried throughout the borehole fluid column from top to bottom. The wireless signal emission is powered by the tubing string mud flow through a turbogenerator associated with the telemetry instrument 30. Consequently, when the tubing string mud flow is interrupted, the signal emission continuity is also interrupted.

Figure 3:
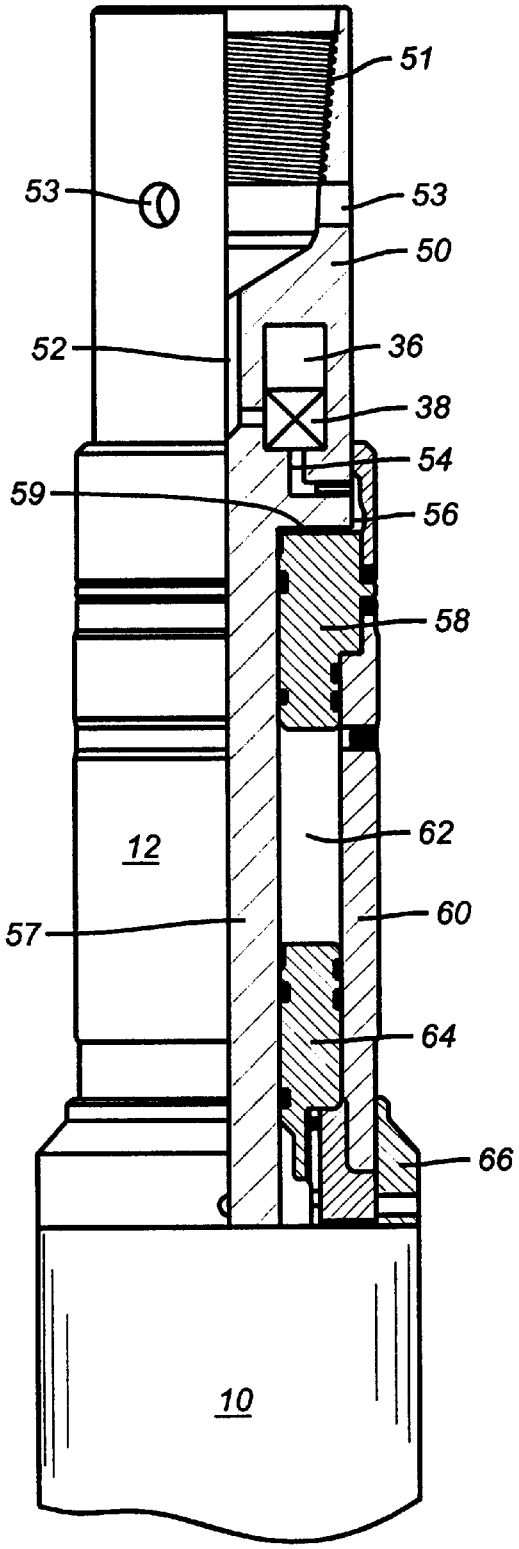
FIG. 3 is a half section of a packer actuator that is energized by hydrostatic wellbore pressure.

With respect to FIG. 3, the packer/slip actuator 12 comprises a shaft mandrel 50 that is secured to the bottom end of the whipstock 14 by a threaded box joint 51. The opposite end of the mandrel is secured to the bottom hole end of the packer/slip unit 10. Around the shank 57 of the mandrel 50 is a displacement assembly comprising a fixed piston 64 and a setting piston 58 separated by a low pressure chamber 62. A cylinder sleeve 60 is secured to a pressure shoulder 66 and encloses the low pressure chamber 62. The setting piston 58 abuts the end of the cylinder sleeve 60 and faces into a motor chamber 59. The head 56 of the motor chamber is formed by an integral shoulder of the mandrel 57.

Within the body of the mandrel 57 is an instrument cavity that contains a signal microprocessor 36 and a solenoid valve 38. The valve 38 controls fluid flow from a conduit 52 into the motor chamber 59 via an actuating conduit 54. Typically, conduit 52 opens into a center chamber within the mandrel box joint 51. Ports 53 open the center chamber to the in situ wellbore pressure. When the valve 38 is opened down hole, hydrostatic wellbore pressure into the motor chamber 59 drives the setting piston 58 and cylinder 60 against the pressure shoulder 66 to set the packer/slip 10.

Figure 4:
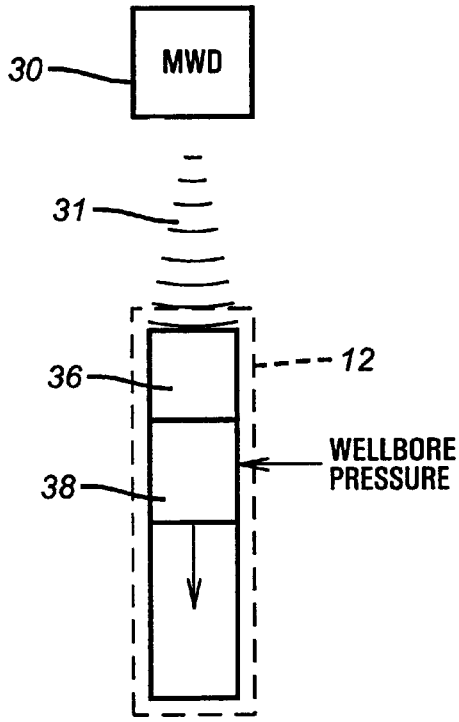
FIG. 4 is a signal process schematic.
Figure 5:
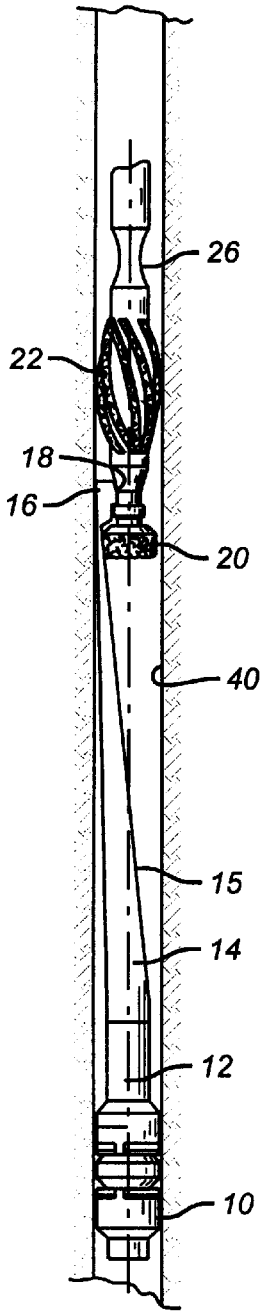
FIG. 5 is a downhole section of the lower invention.
Figure 6:
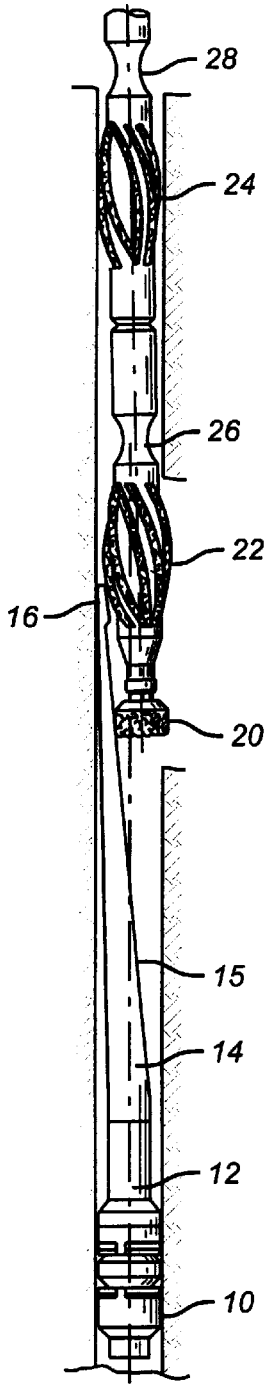
FIG. 6 is a downhole section of the invention casing mill after separation from the whipstock.
Figure 7:
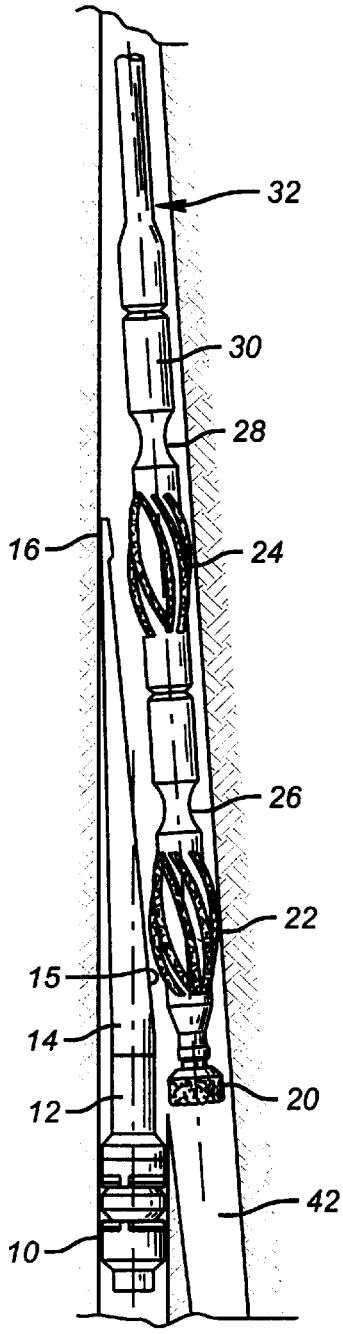
FIG. 7 is a downhole section of the invention in a completed wellbore deviation

A typical operation of the invention assembly is represented by the sequence of FIGS. 5, 6 and 7. Initially, the tool assembly is located at the desired depth of an existing borehole that is lined by a steel casing pipe 40. From the azimuth and borehole deviation data reported by the MWD unit 30, the drill string is rotated to align the whipstock deflection surface 15 as desired. At this point, the drilling fluid circulation pump is stopped or the pump discharge flow diverted from the downhole tubing string. With respect to the process schematic of FIG. 4, when the mud flow stops, the signal flow 31 from the MWD 30 (or LWD) is terminated. Interruption of the MWD signal flow arms the microprocessor 36 for the packer/slip actuator 12. After a two minute quiescent lapse, for example, the mud flow is started again and continued for one minute, for example, and stopped again. This cycle is repeated twice or three times over whereupon the microprocessor 36 responds to the programmed signal sequence by opening the packer/slip solenoid valve 38. When the valve 38 opens, the packer/slip actuating motor chamber 56 is flooded with downhole well fluid at downhole pressure through conduits 52 and 54. In situ well pressure against the face of setting piston 58 drives the pressure shoulder 66 into packer/slip 10 setting mechanism.

With the packer/slip unit 10 set to anchor the lower end of the whipstock, the drill string 32 is rotated to shear the fastener 18 between the whipstock 15 and the drill string 32. The drill string 32 is now free of the whipstock assembly and may be lowered into the wellbore independently of the whipstock. The drill string is rotated while being lowered. As the rotating drill string 32 and casing mill 20 descends against the hardened steel face 15 of the whipstock 14, the casing mill 20 is wedged against the wall of the casing 40 to cut away a window opening in the wall as illustrated by FIG. 6.

Usually, the casing mill 20 is not of the same diameter as the inside diameter of the original casing 40. Hence, the casing window, as originally opened, is smaller than necessary and often fringed with casing metal shards. To expand the window aperture and trim the window perimeter, the casing mill 20 is followed by the reamers 22 and 24. Continued advancement of the drill string 32, bores the pilot of a new bore hole 42.

To this point, the new borehole 42 was cut with a single trip into the original borehole 40. All tools necessary to start and finish the whipstock operation were present at the start of the operation. After the original casing 40 is cut and reamed, the drill string 32 is withdrawn from the borehole and the casing mill and reamers replaced by a traditional rock drill that more efficiently advances the new borehole 42.

Although the invention has been described in the environmental context of setting a whipstock, it will be apparent to those of ordinary skill in the art that the core concept of this invention is the exploitation of a coded sequence of wireless signals from a downhole telemetry instrument having signal power generated by the pumped flow of fluid along a surface connected tubing string . This core concept may be used to control, activate or deactivate other downhole well control equipment such as production packers, production anchors, production valves, cement valves and cross-overs. Telemetry instruments such as MWD or LWD units that exploit the pumped flow of drilling fluid for driving a turbogenerator are merely representative.

It should also be understood that there are numerous alternative to the use of in situ wellbore pressure as an actuating energy source. The signals that actuate the fluid control valve 38 are also suitable to initiate explosives, release compressed gas or release mechanical springs.

Accordingly, modifications and improvements may be made to these inventive concepts without departing from the scope of the invention. The specific embodiments shown and described herein are merely illustrative of the invention and should not be interpreted as limiting the scope of the invention or construction of the claims appended hereto.

What is claimed is:

1. A method of operating a downhole well control tool including the steps of:

(a) providing, in a tubing string for channeling a pumped fluid flow stream, a downhole telemetry instrument for measuring downhole conditions and transmitting wireless data signals from said telemetry instrument corresponding to said downhole conditions;

(b) energizing the transmission of said data signals from said downhole telemetry instrument with said pumped fluid flow stream;

(c) securing a downhole well control tool to said tubing string in isolation from said flow stream;

(d) controlling the operation of in situ wellbore pressure on said well control tool by a microprocessor;

(e) programming said microprocessor to operatively respond to a coded sequence of said data signals; and, (f) controlling said pumped fluid flow stream to transmit said data signals from said downhole telemetry instrument in said coded sequence to operate said well control tool.

2. A method as described by claim 1 wherein said well control tool is a well packer that is actuated by in situ wellbore pressure.

3. A method as described by claim 1 wherein said telemetry instrument is energized by a fluid driven turbogenerator.

4. A method of setting a whipstock including the steps of:

(a) assembling a downhole tool string comprising a string of tubing having a fluid flowbore and a whipstock, said tool string further including a telemetry device uphole of said whipstock_for reporting downhole depth, direction and orientation on data signals generated by a pumped flow of fluid along said fluid flow bore and a wellbore packer below said whipstock, said packer having fluid flow isolation from said pumped fluid flow;

(b) placing said tool string at a desired depth in a wellbore;

(c) orienting the desired direction of said whipstock within said wellbore;

(d) energizing the activation of said packer and slips by in situ wellbore pressure;

(e) controlling the activation of said packer and slips by a microprocessor that is operatively responsive to a coded sequence of data signals from said telemetry device; and, (f) controlling the pumped flow of fluid to transmit said coded sequence of data signals whereby said packer and slips are set at the desired depth and orientation of said whipstock.

5. A method as described by claim 4 wherein said telemetry device is a measuring while drilling instrument.

6. A method as described by claim 4 wherein said telemetry device is a logging while drilling instrument.

7. A downhole well control tool activated by in situ well pressure independently of other, external, pressures, said tool having:

a downhole telemetry instrument for generating a wireless signal sequence for control of an actuator;

an actuator for controlling the application of said in situ well pressure to engage said tool; and a microprocessor responsive to a wireless signal sequence from said downhole telemetry instrument for controlling the operation of said actuator.

8. A downhole well control tool as described by claim 7 wherein said tool is adapted to be secured to a tubing string for channeling fluid pumped from the surface along a tubing bore, said pumped fluid being the energy source of said wireless signal.

9. A downhole tool string comprising:

(a) a whipstock having an uphole end secured to a string of tubing having a fluid flow bore;

(b) a whipstock anchoring device secured to a downhole end of said whipstock, said anchoring device being isolated from a pumped flow of fluid through said fluid flow bore and is operatively energized by in situ wellbore pressure;

(c) a telemetry device for measuring the depth and orientation of said device in a wellbore and transmitting telemetry signals corresponding thereto;

(d) a telemetry signal power generation device driven by a pumped flow of fluid through a tubing bore; and, (e) an anchoring device actuator activated by a coded sequence of telemetry signals to engage said in situ wellbore pressure.

10. A downhole tool string as described by claim 9 wherein said telemetry device is a measuring while drilling instrument.

11. A downhole tool string as described by claim 9 wherein said telemetry device is a logging while drilling instrument.

12. A downhole tool string as described by claim 9 wherein said telemetry signal power generation device is a fluid flow driven turbogenerator.

* * * * *